US012497853B2

(12) United States Patent
Vasques

(10) Patent No.: US 12,497,853 B2
(45) Date of Patent: Dec. 16, 2025

(54) ANNULAR BARRIER

(71) Applicant: Welltec Manufacturing Center Completions ApS, Esbjerg N (DK)

(72) Inventor: Ricardo Reves Vasques, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 63 days.

(21) Appl. No.: 17/854,397

(22) Filed: Jun. 30, 2022

(65) Prior Publication Data

US 2023/0003098 A1 Jan. 5, 2023

(30) Foreign Application Priority Data

Jul. 1, 2021 (EP) ..... 21183251

(51) Int. Cl.
*E21B 33/124* (2006.01)
*E21B 33/12* (2006.01)
*E21B 33/122* (2006.01)

(52) U.S. Cl.
CPC ..... *E21B 33/1243* (2013.01); *E21B 33/1208* (2013.01); *E21B 33/122* (2013.01)

(58) Field of Classification Search
CPC . E21B 33/122; E21B 33/1208; E21B 33/1243
See application file for complete search history.

(56) References Cited

U.S. PATENT DOCUMENTS 4,258,787 A * 3/1981 Amancharla ..... E21B 33/1295 166/212
5,467,822 A * 11/1995 Zwart ..... E21B 33/128 166/179

(Continued)

FOREIGN PATENT DOCUMENTS

EP 2 789 792 10/2014
EP 3 670 826 6/2020

OTHER PUBLICATIONS

Extended EP Search Report for 21183251.4 dated Nov. 19, 2021, 5 pages.

*Primary Examiner* — Eugene G Byrd
(74) *Attorney, Agent, or Firm* — Nixon & Vanderhye P.C.

(57) ABSTRACT

The present invention relates to an annular barrier for providing zonal isolation in an annulus downhole between a well tubular metal structure and another well tubular metal structure or a wall of a borehole, comprising a tubular metal part configured to be mounted as part of the well tubular metal structure, the tubular metal part having an outer face, an opening and an axial extension along the well tubular metal structure, an expandable metal sleeve surrounding the tubular metal part, the expandable metal sleeve having a circumferential groove, a first end and a second end, each end of the expandable metal sleeve being connected with the outer face of the tubular metal part, and a sealing unit arranged in the circumferential groove, the annular sealing unit comprising an annular sealing element and a back-up sealing element abutting and supporting the annular sealing element, wherein the annular sealing element in a cross-section along the axial extension has a first width, a second width and a third width; the second width is larger than the first width and the third width and is arranged between the first width and the third width; the back-up sealing element has a first contact area, and the annular sealing element has a second contact area, where the first contact area has a shape that mates with the second contact area. The invention also relates to a downhole completion system comprising an annular barrier and a well tubular metal structure.

15 Claims, 6 Drawing Sheets

(56) References Cited

U.S. PATENT DOCUMENTS

Figure 1A:
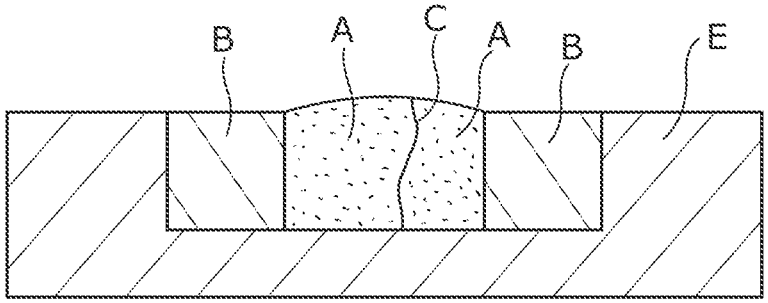
Fig. 1A (Prior Art)

| | | | | |
|---|---|---|---|---|
| 5,775,429 | A * | 7/1998 | Arizmendi | E21B 33/128 166/387 |
| 10,472,920 | B2 * | 11/2019 | Farquhar | E21B 23/06 |
| 10,533,390 | B2 * | 1/2020 | Vasques | E21B 33/1277 |
| 10,634,255 | B2 * | 4/2020 | Urban | F16J 15/166 |
| 2006/0186602 | A1 * | 8/2006 | Martin | E21B 33/1212 277/338 |
| 2008/0156501 | A1 * | 7/2008 | Vinson | E21B 33/1208 166/387 |
| 2016/0123105 | A1 * | 5/2016 | Reinhardt | E21B 33/129 166/387 |
| 2016/0326830 | A1 * | 11/2016 | Hallundbæk | E21B 33/1208 |
| 2017/0175485 | A1 * | 6/2017 | Vasques | E21B 34/16 |
| 2019/0017347 | A1 * | 1/2019 | Kendall | E21B 33/1216 |
| 2020/0165892 | A1 | 5/2020 | Vasques et al. | |
| 2021/0095541 | A1 * | 4/2021 | Anderson | E21B 33/1208 |

* cited by examiner

ANNULAR BARRIER

This application claims priority to EP 21183251.4 filed Jul. 1, 2021, the entire contents of which are hereby incorporated by reference.

The present invention relates to an annular barrier for providing zonal isolation in an annulus downhole between a well tubular metal structure and another well tubular metal structure or a wall of a borehole. The invention also relates to a downhole completion system comprising an annular barrier and a well tubular metal structure.

Annular barriers are used downhole for providing isolation of one zone from another in an annulus in a borehole of a well between a well tubular metal structure and the borehole wall or another well tubular metal structure. During insertion of the annular barrier into the borehole or during the process of setting the annular barrier, e.g. when an expandable metal sleeve has been expanded, fractures or cracks in the sealing elements may develop, and tests have shown that these fractures or cracks may cause fluid to leak across the seals after expansion as the fractures or cracks open up during expansion.

It is an object of the present invention to wholly or partly overcome the above disadvantages and drawbacks of the prior art. More specifically, it is an object to provide an improved annular barrier which has an improved sealing unit able to withstand insertion and expansion without allowing fluid to leak across the sealing unit.

The above objects, together with numerous other objects, advantages and features, which will become evident from the below description, are accomplished by a solution in accordance with the present invention by an annular barrier for providing zonal isolation in an annulus downhole between a well tubular metal structure and another well tubular metal structure or a wall of a borehole, comprising:

- a tubular metal part configured to be mounted as part of the well tubular metal structure, the tubular metal part having an outer face, an opening and an axial extension along the well tubular metal structure,
- an expandable metal sleeve surrounding the tubular metal part, the expandable metal sleeve having a circumferential groove, a first end and a second end, each end of the expandable metal sleeve being connected with the outer face of the tubular metal part, and
- a sealing unit arranged in the circumferential groove, the annular sealing unit comprising an annular sealing element and a back-up sealing element abutting and supporting the annular sealing element, wherein the annular sealing element in a cross-section along the axial extension has a first width, a second width and a third width; the second width is larger than the first width and the third width and is arranged between the first width and the third width; the back-up sealing element has a first contact area, and the annular sealing element has a second contact area, where the first contact area has a shape that mates with the second contact area.

Also, by having the back-up sealing element with a mating shape as that of the annular sealing element having a second width that is larger than the first width and the third width, the back-up sealing element may be able to restrict the annular sealing element from opening a potential crack therein. Thus, even though the annular sealing element has a crack, the back-up sealing element will compress the crack so that no sealing ability is lost.

Moreover, the first contact area and the second contact area may abut each other.

In addition, the back-up sealing element may abut the annular sealing element forming the first contact area of the back-up sealing element and the second contact area of the annular sealing element.

Further, the annular sealing element in a cross-section means the cross-sectional plane extending along the axial extension and a radial extension extending perpendicular thereto, and the annular sealing element along the axial extension may have an extension which is a first width.

Furthermore, the annular sealing element has a second thickness along the radial extension perpendicular to the axial extension, and the second width is arranged at least 10% of the second thickness from the first face and less than 90% of the second thickness from the first face, and preferably the second width is arranged at least 20% of the second thickness from the first face and less than 80% of the second thickness from the first face, and more preferably the second width is arranged at least 30% of the second thickness from the first face and less than 70% of the second thickness from the first face.

Moreover, the first contact area may have a shape that mates with or corresponds to the second contact area. The first contact area may be the inverse shape of the second contact area so as to mate with the second contact area.

In addition, the annular sealing element may comprise a first face facing the circumferential groove and a second face facing away from the circumferential groove; the first width is the width at the first face, and the third width is the width at the second face.

Additionally, the second face may face the other well tubular metal structure and/or the wall of the borehole.

Furthermore, the back-up sealing element may have a first face part and a second face part forming the first contact area of the back-up sealing element; the first face part inclining and facing away from the circumferential groove, and the second face part inclining and facing towards the groove.

Also, by having the first face part inclining and facing away from the circumferential groove, and the second face part inclining and facing towards the groove, the back-up sealing element is able to restrict the annular sealing element from opening a potential crack therein. Thus, even though the annular sealing element has a crack, the back-up sealing element will compress the crack so that no sealing ability is lost.

Further, the first face part may be equal to or larger than the second face part.

Moreover, the first face part may be smaller than the second face part.

In addition, the first face part and/or the second face part may form part of a curvature.

Furthermore, the annular sealing element may also comprise a key ring element surrounding at least part of the back-up sealing element.

Also, the annular barrier may further comprise a second back-up sealing element arranged so that the annular sealing element is between the two back-up sealing elements when seen along the axial extension.

Further, the circumferential groove may be formed between two projections.

Moreover, the first width may be larger than or equal to the third width.

In addition, the first width may be smaller than the third width.

Furthermore, the circumferential groove may have a first end face and a second end face, the first end face and the second end face extending radially to the axial extension.

Also, the first contact area of the back-up sealing elements may have faces facing the annular sealing element, and each back-up sealing element may have an end face opposite the annular sealing element facing and abutting the first end face and the second end face, respectively.

Further, the back-up sealing element may have a first thickness in a direction radial to the axial extension, and the annular sealing element may have a second thickness in a direction radial to the axial extension, the first thickness being substantially equal to or smaller than the second thickness.

Moreover, the circumferential groove may have a depth corresponding to the first thickness and/or the second thickness.

In addition, the annular barrier may further comprise an anchoring element arranged in a second circumferential groove, the anchoring element comprising a first anchoring part at least partly overlapping a second anchoring part in a radial direction perpendicular to the axial extension so that an inner face of the first anchoring part at least partly abuts an outer face of the second anchoring part.

Furthermore, the inner face of the first anchoring part and the outer face of the second anchoring part may be inclined in relation to the axial extension.

Also, the first anchoring part and the second anchoring part may be one monolithic whole.

Further, the first anchoring part may form one monolithic whole, and the second anchoring part may form a second monolithic whole.

Moreover, the first anchoring part may be shaped as a first slit ring, and the second anchoring part may be shaped as a second slit ring.

In addition, the first anchoring part may further comprise an outer face, and the second anchoring part may comprise an inner face; the outer face of the first anchoring part may comprise friction-enhancing means and may face the other well tubular metal structure or the wall of the borehole.

Furthermore, the friction-enhancing means may be spikes or grooves.

Also, the expandable metal sleeve may comprise at least two sealing units, and the anchoring element may be arranged between two sealing units.

Further, the back-up sealing element may be made of elastomer or polymer.

Moreover, the back-up sealing element may be made of Polytetrafluoroethylene (PTFE).

In addition, the key ring element may be made of metal such as spring steel.

Finally, the invention also relates to a downhole completion system comprising an annular barrier and a well tubular metal structure.

Figure 1B:
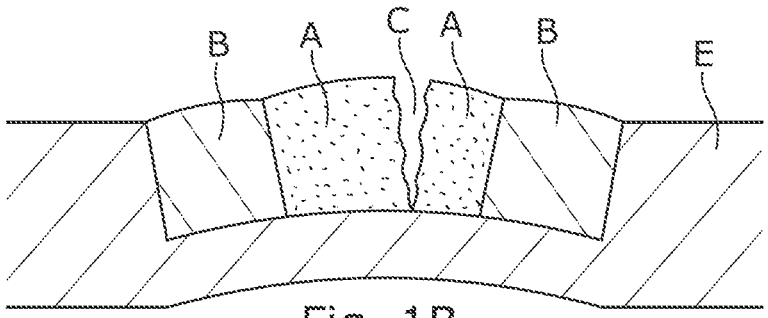
Fig. 1B (Prior Art)
Figure 2A:
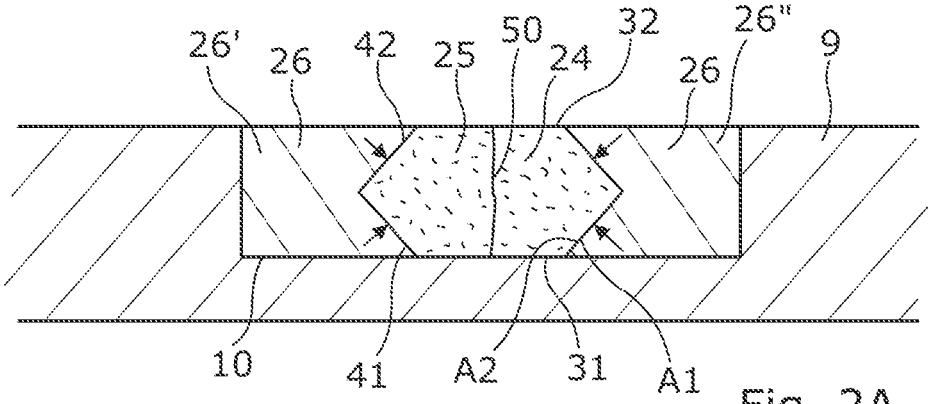
Figure 2B:
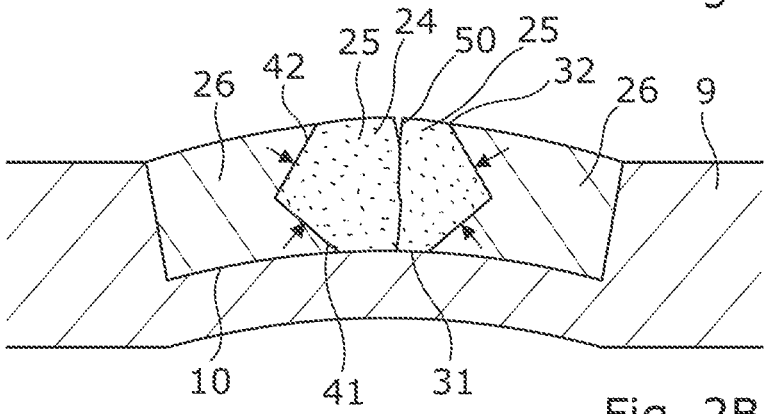
Figure 3:
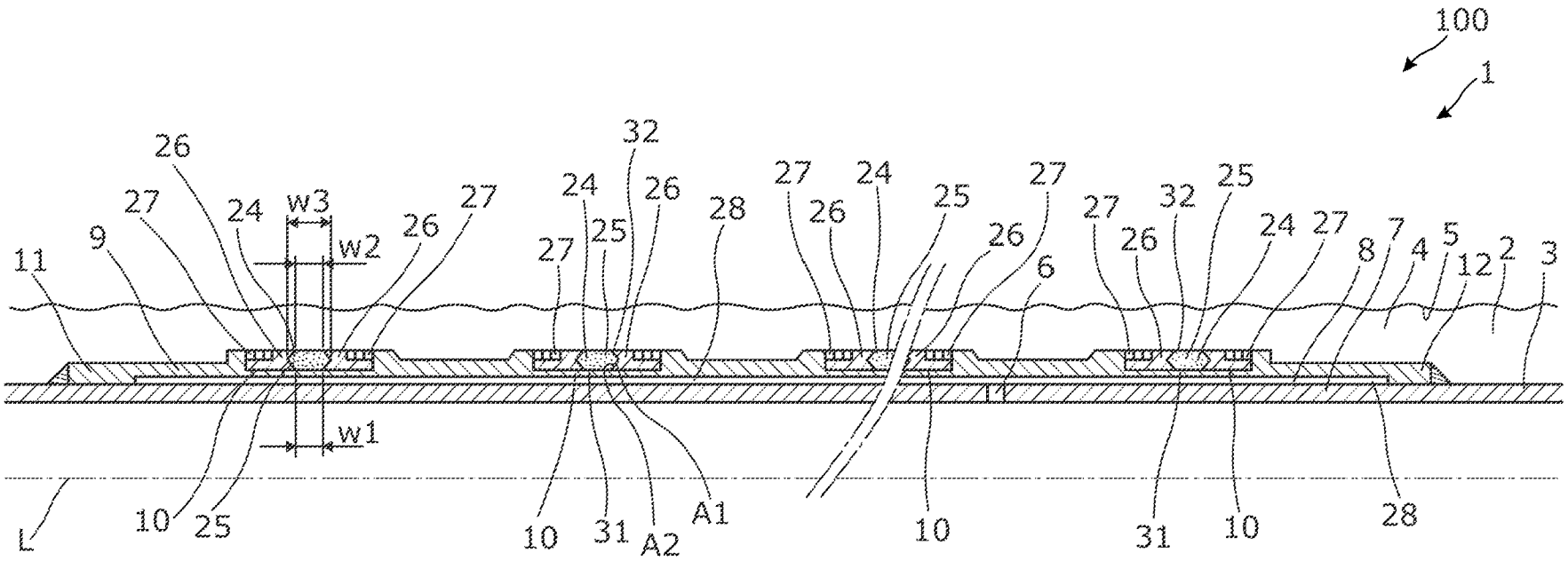
Figure 4:
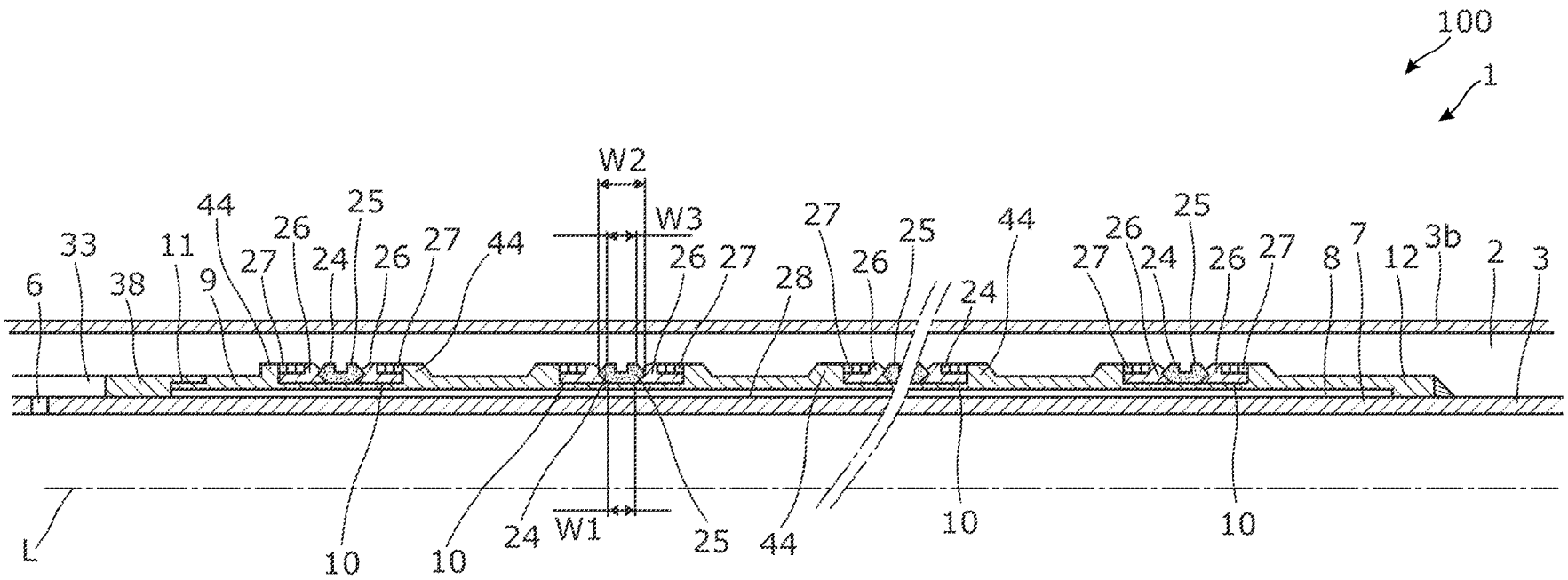
Figure 5:
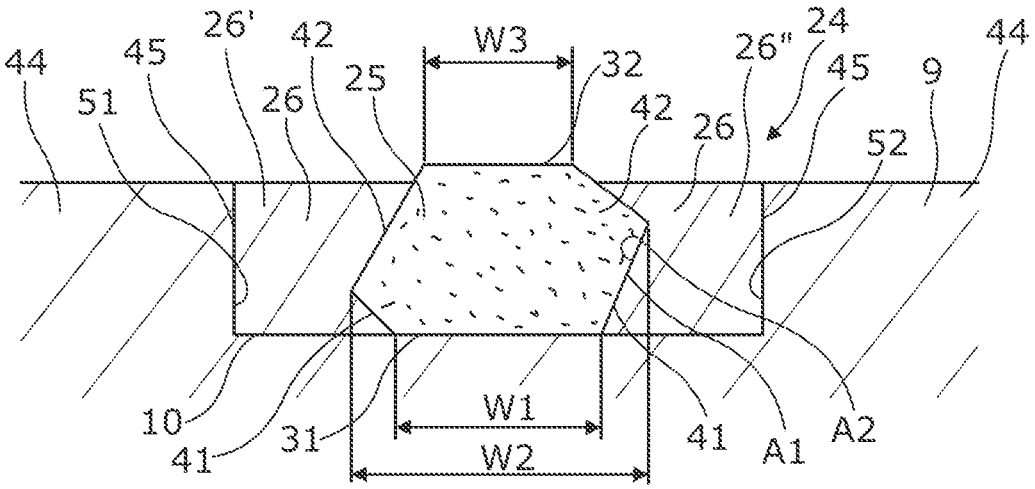
Figure 6:
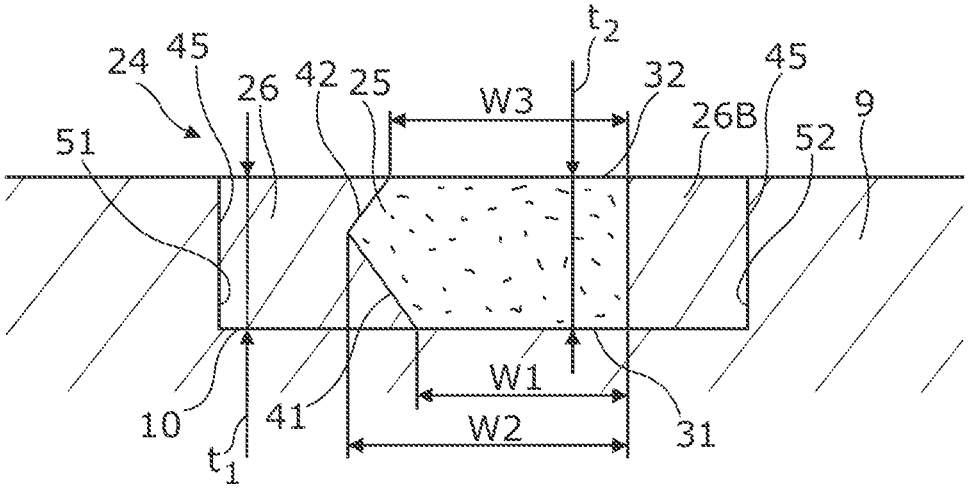
Figure 7:
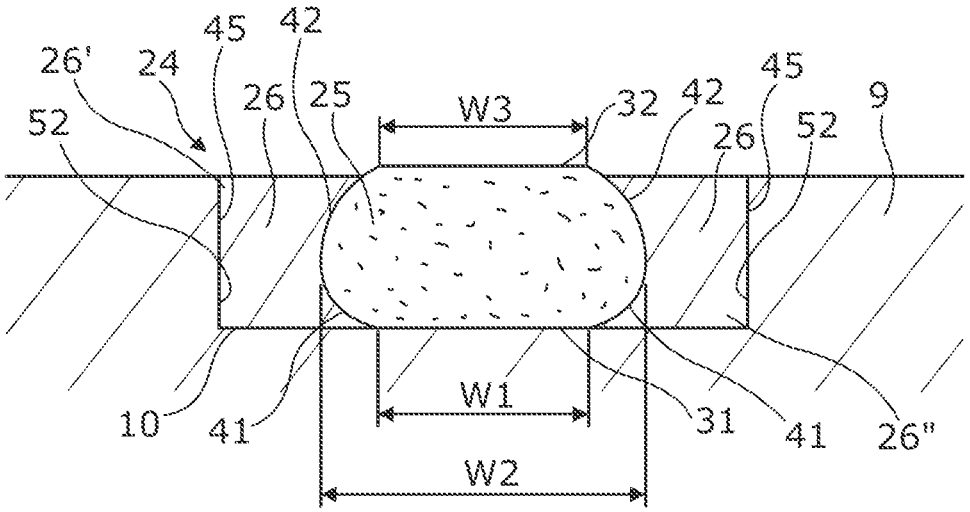
Figure 8:
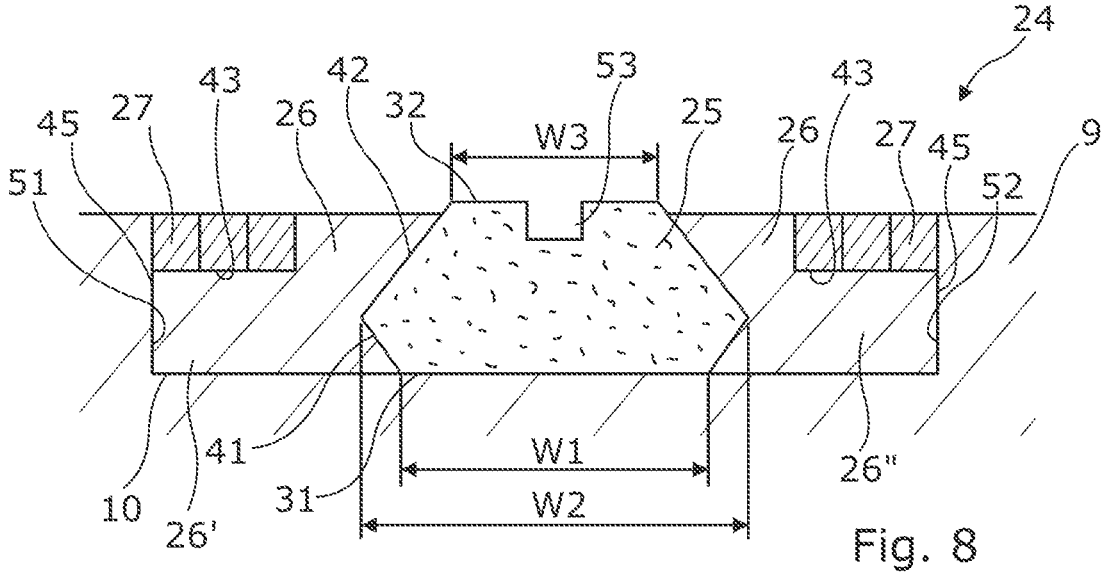
Figure 9:
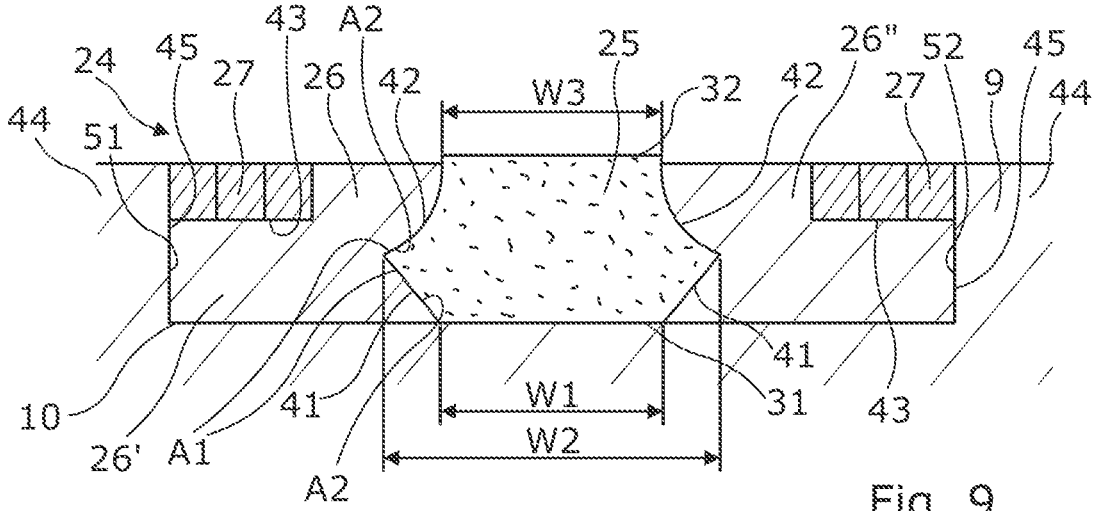
Figure 10:
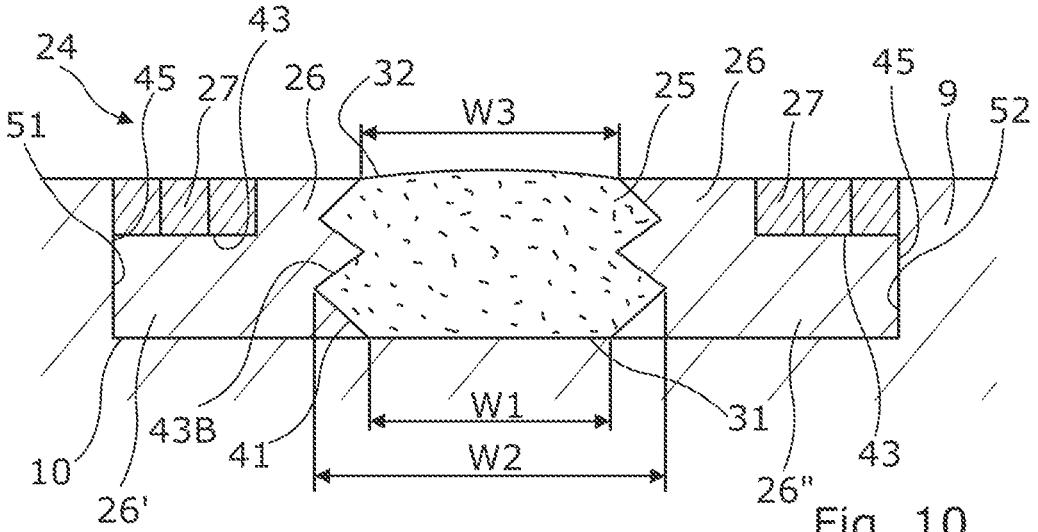
Figure 11:
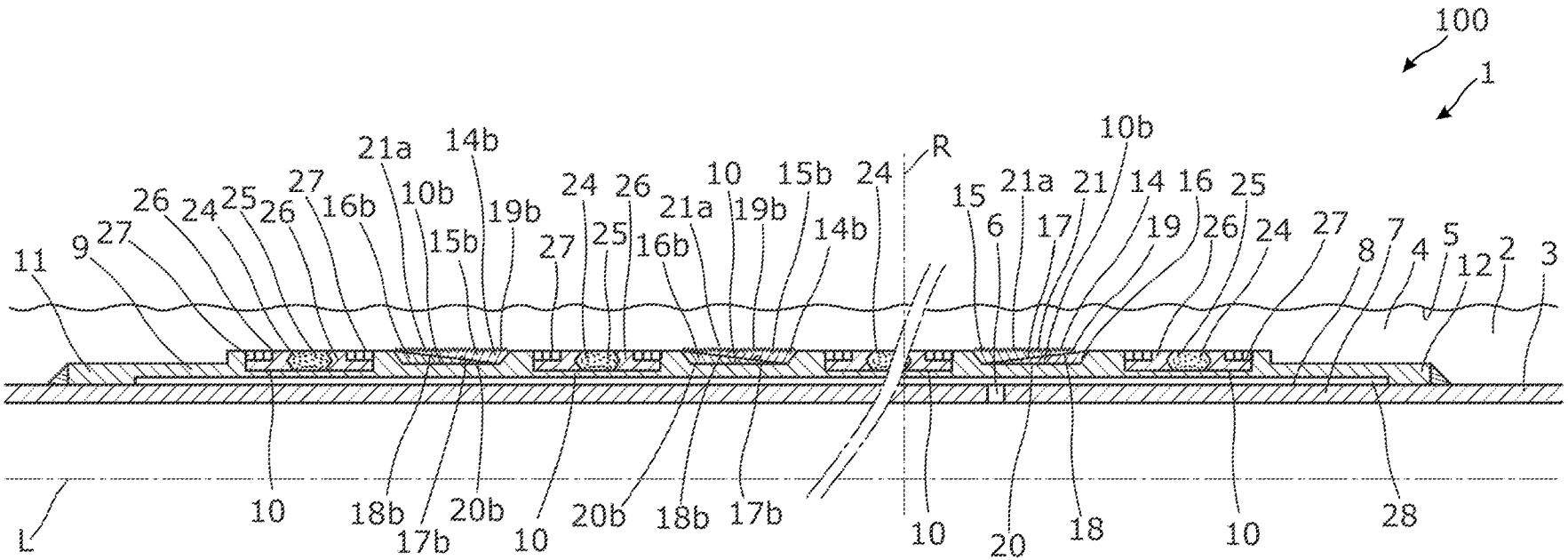

The invention and its many advantages will be described in more detail below with reference to the accompanying schematic drawings, which for the purpose of illustration show some non-limiting embodiments and in which:

FIG. 1A shows a cross-sectional view of a prior art seal in a groove of an annular barrier in its unexpanded condition, FIG. 1B shows the prior art seal of FIG. 1A in its expanded condition, FIG. 2A shows a cross-sectional view of an annular sealing unit in a groove of an annular barrier according to the present invention in its unexpanded condition, FIG. 2B shows the prior art seal of FIG. 2A in its expanded condition in which the back-up sealing element constrains the crack in the annular sealing element, FIG. 3 shows a cross-sectional view of an annular barrier having sealing units, FIG. 4 shows a cross-sectional view of another annular barrier having sealing units, FIG. 5 shows a cross-sectional view of another annular sealing unit comprising two back-up sealing elements having inclined faces constraining the sealing element, FIG. 6 shows a cross-sectional view of yet another annular sealing unit comprising one back-up sealing element having inclined faces constraining the sealing element, FIG. 7 shows a cross-sectional view of yet another annular sealing unit comprising a back-up sealing element having rounded faces constraining the sealing element, FIG. 8 shows a cross-sectional view of yet another annular sealing unit comprising two back-up sealing elements and key ring elements constraining the back-up sealing elements, FIG. 9 shows a cross-sectional view of another annular sealing unit comprising two back-up sealing elements having half-rounded faces constraining the sealing element, FIG. 10 shows a cross-sectional view of another annular sealing unit comprising two back-up sealing elements having several inclining faces constraining the sealing element, and FIG. 11 shows a cross-sectional view of an annular barrier having sealing units and anchoring elements.

All the figures are highly schematic and not necessarily to scale, and they show only those parts which are necessary in order to elucidate the invention, other parts being omitted or merely suggested.

FIG. 3 shows an unexpanded annular barrier 1 for providing zonal isolation in an annulus 2 downhole between a well tubular metal structure 3 and a wall 5 of a borehole 4, or another well tubular metal structure 3*b*, as shown in FIG. 4. The annular barrier 1 comprises a tubular metal part 7 configured to be mounted as part of the well tubular metal structure 3, where the tubular metal part 7 has an outer face 8, an opening 6 for letting fluid in during expansion of the annular barrier 1 and an axial extension L along the well tubular metal structure 3. The annular barrier 1 comprises an expandable metal sleeve 9 surrounding the tubular metal part 7 and having a circumferential groove 10, a first end 11 and a second end 12, and each end of the expandable metal sleeve 9 is connected with the outer face 8 of the tubular metal part 7. The annular barrier 1 further comprises an annular sealing unit 24 arranged in the circumferential groove 10 of the expandable metal sleeve 9, and the annular sealing unit 24 comprises an annular sealing element 25 and a back-up sealing element 26 abutting and supporting the annular sealing element 25. In a cross-section along the axial extension L, the annular sealing element 25 has a first width W1, a second width W2 and a third width W3, and the second width W2 is larger than the first width W1 and the third width W3 and is arranged between the first width W1 and the third width W3. The back-up sealing element 26 has a first contact area A1, and the annular sealing element 25 has a second contact area A2, where the first contact area A1 has a shape that mates with the second contact area A2, as shown in FIG. 2A. The annular sealing element 25 in a cross-section along the axial extension L means the cross-sectional plane extending in an axial extension L, and a radial extension along the axial extension L has a first width W1.

By having the back-up sealing element 26 with a mating shape as that of the annular sealing element 25 having the second width W2 that is larger than the first width W1 and the third width W3, the back-up sealing element 26 is able to restrict the annular sealing element 25 from opening a potential crack 50 therein, as illustrated by arrows in FIG. 2A. Thus, even though the annular sealing element 25 has a crack 50, the back-up sealing element 26 will compress the crack 50 so that no sealing ability is lost. In prior art seals A having a back-up element B in the groove of the expandable sleeve E, as shown in FIG. 1A, a crack C in the seal A will be forced open as shown in FIG. 1B as the seal A is not restricted, and then there is a risk of fluid leaking across the seal A.

As seen in FIG. 2A, the annular sealing element 25 comprises a first face 31 facing the circumferential groove 10 and a second face 32 facing away from the circumferential groove 10; the first width W1 (shown in FIG. 3) is the width at the first face 31, and the third width W3 (shown in FIG. 3) is the width at the second face 32.

Thus, the first contact area A1 has a shape that mates with or corresponds to the second contact area A2. The first contact area A1 may thus be the inverse shape of the second contact area A2 so as to mate with the second contact area A2.

As shown in FIGS. 2A, 2B and 5-10, the back-up sealing element 26 has a first face part 41 and a second face part 42 forming the first contact area A1 of the back-up sealing element 26; the first face part 41 inclines and faces away from the circumferential groove 10, and the second face part 42 inclines and faces towards the circumferential groove 10.

When expanding the expandable metal sleeve 9, cracks or fractures may occur in the elastomeric sealing element; however, if restricted by the back-up sealing element 26, such cracks or fractures will not damage the function of the annular sealing unit 24. Thus, by having the first face part 41 inclining and facing away from the circumferential groove 10, and the second face part 42 inclining and facing towards the circumferential groove 10, the back-up sealing element 26 is able to restrict the annular sealing element 25 from opening a potential crack 50 therein. Therefore, even though the annular sealing element 25 has a crack 50, the back-up sealing element 26 will compress the crack 50 so that no sealing ability is lost.

In FIG. 2A, the first face part 41 of the back-up sealing element 26 is equal to the second face part 42, and the back-up sealing element 26 is thus symmetrical around a centre line along the axial extension L when seen in cross-section as in FIG. 2A. The annular sealing unit 24 has two back-up sealing elements 26', 26" arranged one on each side and both having a shape matching the shape of the annular sealing element 25 so as to form an optimal back-up seal.

To the left in the cross-sectional view of the annular sealing unit 24 of FIG. 5, the first face part 41 of the back-up sealing element 26' is smaller than the second face part 42, and to the right the first face part 41 of the back-up sealing element 26" is larger than the second face part 42. Thus, the two back-up sealing elements 26', 26" may be of a different shape and be designed to be arranged at different locations along the axial extension L of the annular barrier 1. The annular sealing units 24 may be arranged at a location where the pressure along one annular sealing unit 24 is varying, and thus the shape of the back-up sealing element 26 has a similar varying shape so as to match the varying pressure and so as to cope with larger pressure on the annular sealing unit 24 from one side than from the opposite side. The first width W1 of the annular sealing element 25 is larger than the third width W3, but in FIGS. 2A and 7 the first width W1 of the annular sealing element 25 is equal to the third width W3.

In FIG. 6, a second back-up sealing element 26B is arranged so that the annular sealing element 24 is between the two back-up sealing elements 26, 26B when seen along the axial extension L. As mentioned above, the second back-up sealing element 26B does not necessarily have the same shape as the other back-up sealing element 26, 26', but it may have a straighter contact area towards the annular sealing element 25. In FIG. 6, the second width W2 of the annular sealing element 25 is also larger than the first width W1 and the third width W3; however, the first width W1 of the annular sealing element 25 is smaller than the third width W3.

In FIG. 7, the first face part 41 and the second face part 42 of the first back-up sealing element 26' form a curvature, and the first face part 41 and the second face part 42 of the second back-up sealing element 26" form a curvature. As can be seen in FIG. 7, the second width W2 of the annular sealing element 25 is also larger than the first width W1 and third width W3, and the back-up sealing elements 26 are able to restrict the annular sealing element 25 arranged therebetween.

The back-up sealing element has a first thickness, and the annular sealing element has a second thickness $t_2$ along the radial extension perpendicular to the axial extension, and the second width W2 is arranged at least 10% of the second thickness from the first face and less than 90% of the second thickness from the first face. In FIG. 3, the second width is arranged approximately 50% of the second thickness from the first face, and in FIG. 6 the second width is arranged approximately 60% of the second thickness from the first face. In FIG. 8, the second width is arranged approximately 35% of the second thickness from the first face and in FIG. 9. In FIGS. 5 and 10, the second width is arranged at least 20% of the second thickness from the first face and less than 80% of the second thickness from the first face.

In FIGS. 8-10, the annular sealing element 25 further comprises a key ring element 27 surrounding part of the back-up sealing element 26 to maintain the back-up sealing element 25 in the circumferential groove 10 during insertion of the annular barrier 1 and also during and after expansion. The back-up sealing elements 26 thus have a circumferential recess 43 to accommodate the key ring element 27, the key ring elements 27 unwind as the expandable metal sleeve 9 is expanding, and the key ring elements are made of metal such as spring steel. As shown in FIG. 8, the annular sealing element 25 has a groove 53. As shown in FIG. 9, the circumferential groove 10 is formed between two projections 44 in the expandable metal sleeve 9. The circumferential groove 10 has a first end face 51 and a second end face 52, and the first end face 51 and the second end face 42 extend radially to the axial extension L so as to provide back-up to the back-up sealing element 26. The first contact area A1 of the back-up sealing elements 26, 26', 26" have faces 41, 42 facing the annular sealing element 25, and each back-up sealing element 26', 26" has an end face 45 opposite the annular sealing element 25 facing and abutting the first end face 51 and the second end face 52, respectively.

As shown in FIG. 6, the back-up sealing element 26 has a first thickness $t_1$ in a direction radial to the axial extension L, and the annular sealing element 25 has a second thickness $t_2$ in a direction radial to the axial extension L, where the second thickness $t_2$ is substantially equal to or larger than the first thickness $t_1$, as shown in FIGS. 7-9. In FIG. 10, the first thickness $t_1$ is varying as the second face 32 is curved slightly radially outwards away from the circumferential groove 10. The circumferential groove 10 has a depth corresponding to the first thickness $t_1$ and the second thickness $t_2$.

Furthermore, in FIG. 10 the annular sealing element 25 has the circumferential recess 43B, and the back-up sealing element 26 has a shape matching the circumferential recess 43B so as to mate with the circumferential recess 43B.

Each end 11, 12 of the expandable metal sleeve 9 is connected with the outer face 8 of the tubular metal part 7, e.g. by means of a connection part 38 as shown in FIG. 4 and/or by means of weld metal as shown in FIG. 3. In FIG. 4, the annular barrier 1 further comprises a valve assembly 33 fluidly connected with the opening 6 and an expandable space 28 so as to fluidly connect the opening 6 and the expandable space 28 during expansion of the expandable metal sleeve 9 and close the fluid connection after the expandable metal sleeve 9 has been properly expanded. The valve assembly 33 may in the second position open for a fluid connection between the annulus 2 and the expandable space 28 in order to equalise the pressure therebetween.

In FIG. 11, the annular barrier 1 further comprises an anchoring element 14 arranged in a second circumferential groove 10*b*. The anchoring element 14 comprises a first anchoring part 15 at least partly overlapping a second anchoring part 16 in a radial direction perpendicular to the axial extension L so that an inner face 17 of the first anchoring part 15 at least partly abuts an outer face 18 of the second anchoring part 16.

In order to provide increased anchoring during axial loading of the annular barrier 1, the inner face 17 of the first anchoring part 15 and the outer face 18 of the second anchoring part 16 are inclined in relation to the axial extension L. Thus, when the temperature changes, and at least part of the expandable metal sleeve 9 moves in one direction along the axial direction L, the first anchoring part 15 moves in an opposite direction along the inclined outer face 18 of the second anchoring part 16, and the first anchoring part 15 is then forced radially outwards, anchoring the expandable metal sleeve 9 even further to the other well tubular metal structure 3*b* (shown in FIG. 4) or the wall 5 of the borehole 4.

An outer face 19, 19*b* of the first anchoring part 15, 15*b* comprises friction-enhancing means 21, such as spikes 21*a*, as shown in FIG. 11, or is provided with grooves (not shown). The annular barrier 1 further comprises a second anchoring element 14*b* comprising a first anchoring part 15*b* at least partly overlapping a second anchoring part 16*b* in a radial direction perpendicular to the axial extension L so that an inner face 17*b* of the first anchoring part 15*b* at least partly abuts an outer face 18*b* of the second anchoring part 16*b*. The inner face 17, 17*b* of the first anchoring part 15, 15*b* and the outer face 18, 18*b* of the second anchoring part 16, 16*b* have low friction between them so that no substantial force is lost in order for the anchoring parts to slide in relation to each other. Thus, the inner face 17, 17*b* of the first anchoring part 15, 15*b* and the outer face 18, 18*b* of the second anchoring part 16, 16*b* have lower friction between them than between the inner face 20, 20*b* of the second anchoring part 16, 16*b* and the circumferential groove 10. The inner face 17*b* of the first anchoring part 15*b* and the outer face 18*b* of the second anchoring part 16*b* are inclined in relation to the axial extension L in an opposite direction to that of the first anchoring element 14. The first anchoring element 14 has inclined faces which, when mirrored around a line R, correspond to the inclined faces of the second anchoring element 14*b*. By having first anchoring elements 14 with inclined faces in one direction and second anchoring elements 14*b* with inclined faces in an opposite direction as shown in FIG. 11, the annular barrier 1 can withstand axial loads in both directions along the axial extension L as the first anchoring elements 14 are activated when the axial load is in one direction, and the second anchoring elements 14*b* are activated when the axial load pulls in the opposite direction. In FIG. 11, the first anchoring part 15 forms one monolithic whole, and the second anchoring part 16 forms a second monolithic whole. The first anchoring part 15 is shaped as a first slit ring, and the second anchoring part 16 is shaped as a second slit ring in order to be able to widen and thus to be mounted in the circumferential groove 10*b*. The annular barrier 1 comprises several sealing units 24, and the anchoring elements 14, 14*b* are arranged between two sealing units 24.

The annular sealing element 25 is made of elastomer or polymer. The back-up sealing element 26 is preferably made of Polytetrafluoroethylene (PTFE), and the key ring element 27 is made of metal, such as spring steel.

In FIGS. 3, 4 and 11, a downhole completion system 100 comprises an annular barrier 1 as described above, and the tubular metal part 7 of the annular barrier 1 is mounted as part of the well tubular metal structure 3.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. An annular barrier for providing zonal isolation in an annulus downhole between a well tubular metal structure and another well tubular metal structure or a wall of a borehole, comprising:

a tubular metal part configured to be mounted as part of the well tubular metal structure, the tubular metal part having an outer face, an opening and an axial extension along the well tubular metal structure, an expandable metal sleeve surrounding the tubular metal part, the expandable metal sleeve having a circumferential groove, a first end and a second end, each end of the expandable metal sleeve being connected with the outer face of the tubular metal part, wherein the expandable metal sleeve defines an expandable space being in fluid communication with the opening in the tubular metal part for fluidly expanding the expandable metal sleeve from a first radial position to a second radial position that is different than the first radial position, and a sealing unit arranged in the circumferential groove, the annular sealing unit comprising an annular sealing element and a back-up sealing element abutting and supporting the annular sealing element, wherein the annular sealing element in a cross-section along the axial extension has a first width, a second width and a third width; the second width is larger than the first width and the third width and is arranged between the first width and the third width; the back-up sealing element has a first contact area, and the annular sealing element has a second contact area, where the first contact area has a shape that mates with the second contact area, wherein the back-up sealing element has a first face part and a second face part forming the first contact area of the back-up sealing element; the first face part inclines and faces away from the groove, and the second face part inclines and faces towards the groove.

2. An annular barrier according to claim 1, wherein the annular sealing element comprises a first face facing the circumferential groove and a second face facing away from the circumferential groove; the first width is the width at the first face, and the third width is the width at the second face.

3. An annular barrier according to claim 1, wherein the first face part is equal to or larger than the second face part.

4. An annular barrier according to claim 1, wherein the first face part is smaller than the second face part.

5. An annular barrier according to claim 1, wherein the first face part and/or the second face part form(s) part of a curvature.

6. An annular barrier according to claim 1, wherein the annular sealing element further comprises a key ring element surrounding at least part of the back-up sealing element.

7. An annular barrier according to claim 1, further comprising a second back-up sealing element arranged so that the annular sealing element is between the two back-up sealing elements when seen along the axial extension.

8. An annular barrier according to claim 1, wherein the circumferential groove is formed between two projections.

9. An annular barrier according to claim 1, wherein the first width is larger than or equal to the third width.

10. An annular barrier according to claim 1, wherein the first width is smaller than the third width.

11. An annular barrier according to claim 1, wherein the circumferential groove has a first end face and a second end face, the first end face and the second end face extending radially to the axial extension.

12. An annular barrier according to claim 1, wherein the back-up sealing element has a first thickness in a direction radial to the axial extension, and the annular sealing element has a second thickness in a direction radial to the axial extension, the first thickness being substantially equal to or smaller than the second thickness.

13. An annular barrier according to claim 1, further comprising an anchoring element arranged in a second circumferential groove, the anchoring element comprising a first anchoring part at least partly overlapping a second anchoring part in a radial direction perpendicular to the axial extension so that an inner face of the first anchoring part at least partly abuts an outer face of the second anchoring part.

14. Downhole completion system comprising an annular barrier according to claim 1 and a well tubular metal structure.

15. An annular barrier according to claim 1, wherein the back-up sealing element in cross section along the axial extent has a first width, a second width and a third width, the second width being larger than the first width and the third width, the second width being arranged between the first width and the third width, so as to lock the annular sealing element in place.

* * * * *